US009675116B2

(12) United States Patent
Liu

(10) Patent No.: US 9,675,116 B2
(45) Date of Patent: Jun. 13, 2017

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 674 days.

(21) Appl. No.: 14/098,101

(22) Filed: Dec. 5, 2013

(65) Prior Publication Data

US 2015/0034107 A1 Feb. 5, 2015

(30) Foreign Application Priority Data

Jul. 31, 2013 (CN) ..... 2013 2 0464066 U

(51) Int. Cl.
*A24F 47/00* (2006.01)
*A61M 15/06* (2006.01)

(52) U.S. Cl.
CPC ..... *A24F 47/008* (2013.01)

(58) Field of Classification Search
CPC ..... A24F 47/00; A61M 15/06
See application file for complete search history.

(56) References Cited

U.S. PATENT DOCUMENTS

2009/0095311 A1* 4/2009 Han ..... A24F 47/008 131/194
2009/0302019 A1* 12/2009 Selenski ..... A24F 47/008 219/201
2011/0011396 A1* 1/2011 Fang ..... A24F 47/008 128/202.21
2012/0145169 A1* 6/2012 Wu ..... A24F 47/008 131/273
2012/0260926 A1* 10/2012 Tu ..... A24F 47/008 131/329
2013/0152922 A1* 6/2013 Benassayag ..... A61M 15/06 128/202.21
2013/0228191 A1* 9/2013 Newton ..... A24F 47/008 131/329

* cited by examiner

*Primary Examiner* — Cynthia Szewczyk
(74) *Attorney, Agent, or Firm* — Tim Tingkang Xia, Esq.; Locke Lord LLP

(57) ABSTRACT

This present application discloses an electronic cigarette, comprising an atomizer and a battery rod, a connecting structure, and an elastic structure; the connecting structure includes a first connecting member and a second connecting member; the first connecting member is provided with at least one engaging portion, the second connecting member defines a butt-jointed groove, a wall of the butt-jointed groove extends away from a rabbet of the butt-jointed groove to form at least one channel structure, the channel includes an inserting guide channel, a taking-out guide channel, and a bending channel, and the bending channel forms a buckled portion; the elastic structure is configured for supplying elasticity towards the rabbet of the butt-jointed groove to the first connecting member, so that the engaging portion is engaged with the buckled portion. The non-threaded connecting structure is simple and is convenient to operate, which improves users' experience.

16 Claims, 8 Drawing Sheets

ELECTRONIC CIGARETTE

CROSS-REFERENCE TO RELATED APPLICATIONS

This non-provisional application claims priority under 35 U.S.C. §119(a) on Patent Application No. 201320464066.7, filed in P.R. China on Jul. 31, 2013, the entire contents of which are hereby incorporated by reference.

FIELD OF THE INVENTION

This present application relates to the field of electrical heating technology, and more particularly to an electronic cigarette.

BACKGROUND OF THE INVENTION

An electronic cigarette generally includes a battery rod and an atomizer. In an electronic cigarette in the prior art, the method for connecting the atomizer with the battery rod is usually a threaded connection. By rotating either the atomizer or the battery rod, physical and electrical connections between the atomizer and the battery rod can be established. When smoke oil in the atomizer is finished, by rotating the atomizer reversely, the atomizer can be detached from the battery rod and be replaced by a new one.

However, in the threaded connection method, it is difficult to judge whether the battery rod and the atomizer are located in correct places or not. Therefore, the battery rod and the atomizer may dislocate from each other, assembly and disassembly of the thread connection are inconvenient and not human-based, and users' experience is poor. When users use electronic cigarettes using the threaded connection method, the users may usually generate psychological resistance, which is not conducive to quit smoking. Additionally, since an appearance and a hand feeling of an electronic cigarette are required to imitate that of a real cigarette to the greatest extent and the electronic cigarette itself has many components, a diameter of the electronic cigarette is small, and a wall of the electronic cigarette is thin. Thus, when screw threads are formed on the electronic cigarette, not only the manufacture is inconvenient, but also the mechanical strength of the electronic cigarette is reduced. The electronic cigarette is prone to be broken, and a service life of the electronic cigarette is short.

SUMMARY OF THE INVENTION

The object of the present application is to provide an electronic cigarette using a non-threaded connection method, thereby solving the problem in the prior art that the mechanical strength of the electronic cigarette with a threaded connection structure is reduced and a service life of the electronic cigarette is short.

In order to realize the object mentioned above, an electronic cigarette comprises an atomizer, a battery rod, and a connecting structure disposed at a butt-jointed position between the atomizer and the battery rod to connect the atomizer with the battery rod; the connecting structure includes a first connecting member and a second connecting member; the electronic cigarette further comprises an elastic structure disposed on an end of the connecting structure; a side surface of the first connecting member is provided with at least one engaging portion, the second connecting member defines a butt-jointed groove configured for receiving the first connecting member, and at least one channel structure is defined on an inner sidewall of the second connecting member along an axial direction of the second connecting member, the channel structure extends toward an opposite direction of a rabbet of the butt-jointed groove and is communicated with the butt-jointed groove; the channel structure includes an inserting guide channel, a taking-out guide channel, and a bending channel communicating with both a first bottom of the inserting guide channel and a second bottom of the taking-out guide channel respectively; the bending channel bends towards the rabbet of the butt-jointed groove and forms a buckled portion at a bending part of the bending channel; the elastic structure is configured for supplying elasticity towards the rabbet of the butt-jointed groove to the first connecting member, so that the engaging portion is engaged with the buckled portion to realize a connection between the atomizer and the battery rod.

The electronic cigarette further includes an electrode sleeve axially inserted in the second connecting member and a second electrode inserted in a central position of the electrode sleeve.

The elastic structure is a spring, and the spring is sheathed on the second electrode and is abutted against the second electrode and the electrode sleeve respectively.

The side surface of the first connecting member is provided with a pair of the engaging portions, and the second connecting member defines a pair of the channel structures corresponding to the pair of the engaging portions.

Both the inserting guide channel and the taking-out guide channel lean relative to an axis of the second connecting member, and the taking-out guide channel and the inserting guide channel lean to two opposite directions respectively.

The inserting guide channel and the taking-out guide channel are formed symmetrically based on the axis of the second connecting member.

A first top of the inserting guide channel communicates with a second top of the taking-out guide channel, and a first middle portion of the inserting guide channel is separated from a second middle portion of the taking-out guide channel.

The first middle portion of the inserting guide channel extends away from the axis of the second connecting member along a distal end of the first top, and the first bottom of the inserting guide channel extends towards the axis of the second connecting member along a distal end of the first middle portion.

The second middle portion of the taking-out guide channel extends away from the axis of the second connecting member along a distal end of the second top, and the second bottom of the taking-out guide channel extends towards the axis of the second connecting member along a distal end of the second middle portion.

A distal end of the engaging portion has a spherical shape.

The first connecting member and the engaging portion are integrally formed.

The first connecting member and the second connecting member are disposed coaxially with each other.

The second connecting member is disposed on one end of the battery rod facing the atomizer or on one end of the atomizer facing the battery rod.

The first connecting member is disposed on one end of the atomizer facing the battery rod or on one end of the battery rod facing the atomizer.

The electronic cigarette further includes a first insulation sleeve axially inserted in the first connecting member and a first electrode inserted in a central position of the first insulation sleeve.

The connecting structure defines an airflow passage communicating the first connecting member with the second connecting member.

By implementing the electronic cigarette of the present application, the following advantages can be achieved: the present application provides a non-threaded connecting structure with an elastic structure, wherein the elastic structure supplies elasticity to press the connecting structure and thereby establish connection of the connecting structure. Because the non-threaded connecting structure of the present application does not need to form a screw thread in an electronic cigarette using the non-threaded connecting structure, the mechanical strength of the electronic cigarette is ensured. Thus, the electronic cigarette is not easy to be broken, and a service life of the electronic cigarette is prolonged. Meanwhile, the non-threaded connecting structure is simple and is convenient to operate, which improves users' experience.

DETAILED DESCRIPTION OF THE PREFERRED EMBODIMENT

Figure 1:
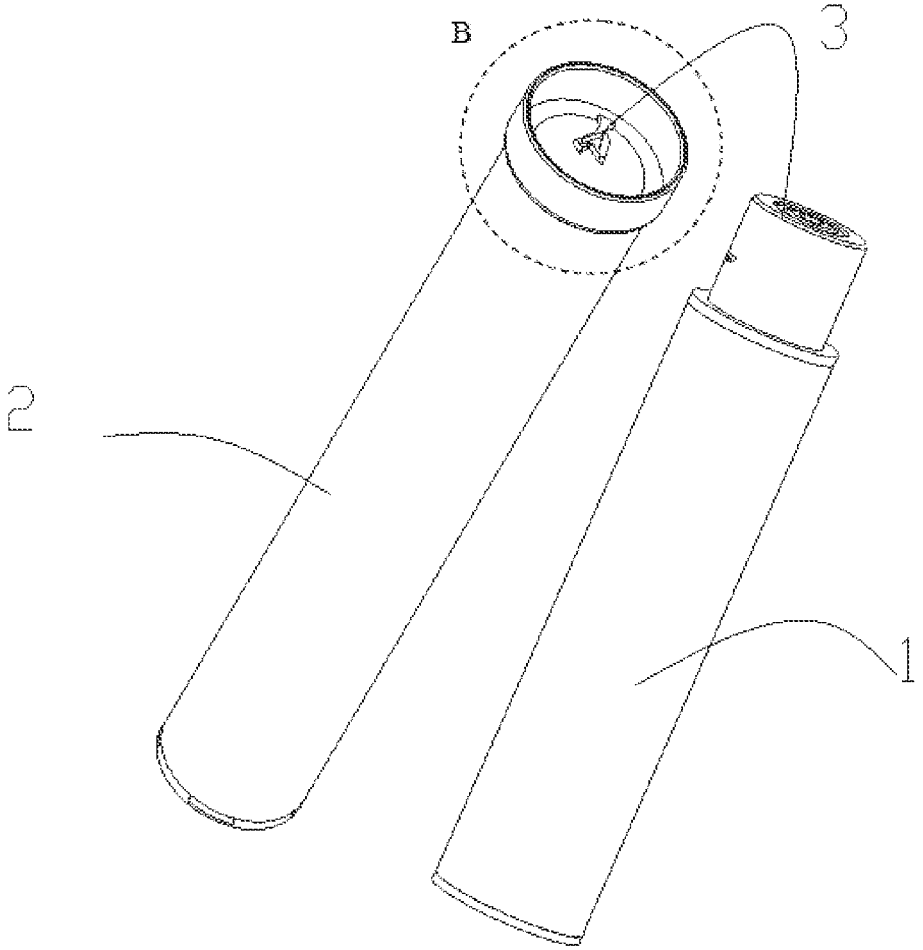
FIG. 1 is a schematic view of an electronic cigarette, in accordance with a preferred embodiment of the present application.

In order to understand the technical features, the purpose and the effect of the present application more clearly, the specific embodiments of the present application will be described referring to the drawings.

Figure 2:
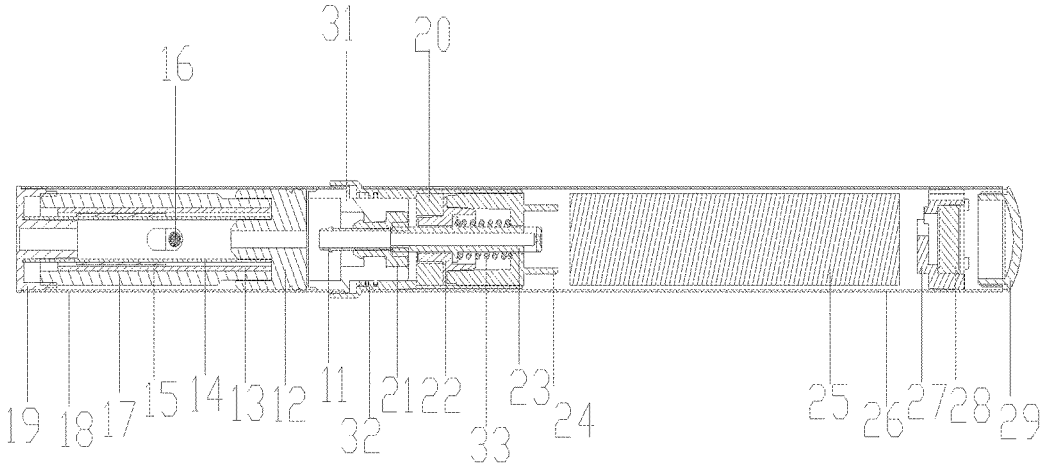
FIG. 2 is a cut-away view of the electronic cigarette shown in FIG. 1.
Figure 3:
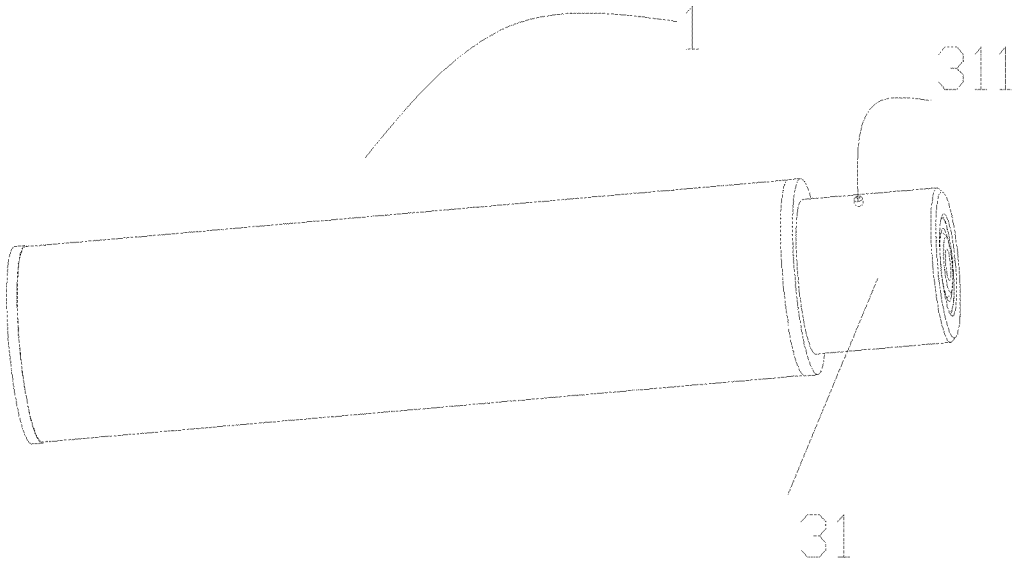
FIG. 3 is a structural schematic view of an atomizer of the electronic cigarette shown in FIG. 1.
Figure 4:
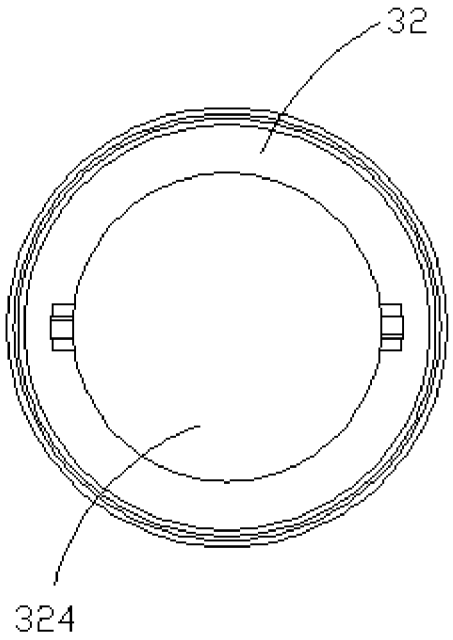
FIG. 4 is a vertical view of a second connecting member of the electronic cigarette shown in FIG. 1.
Figure 5:
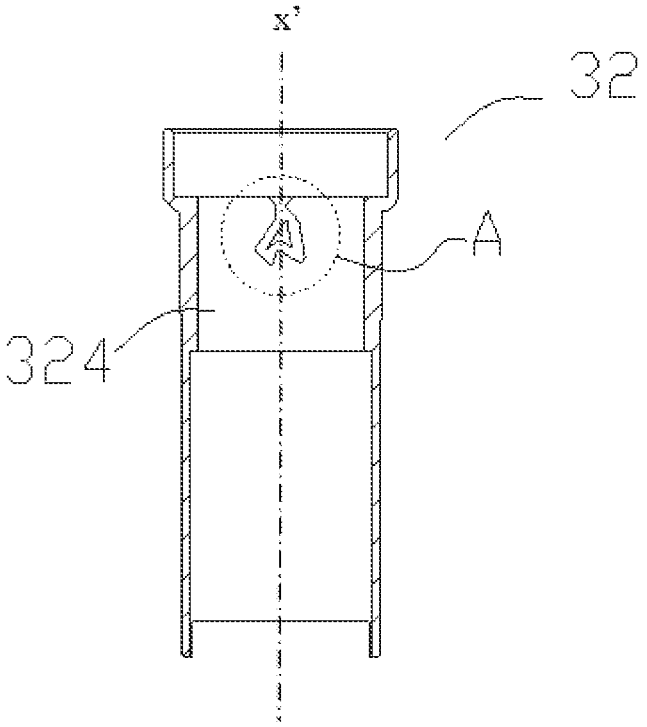
FIG. 5 is a cut-away view of a second connecting member of the electronic cigarette shown in FIG. 1.
Figure 6:
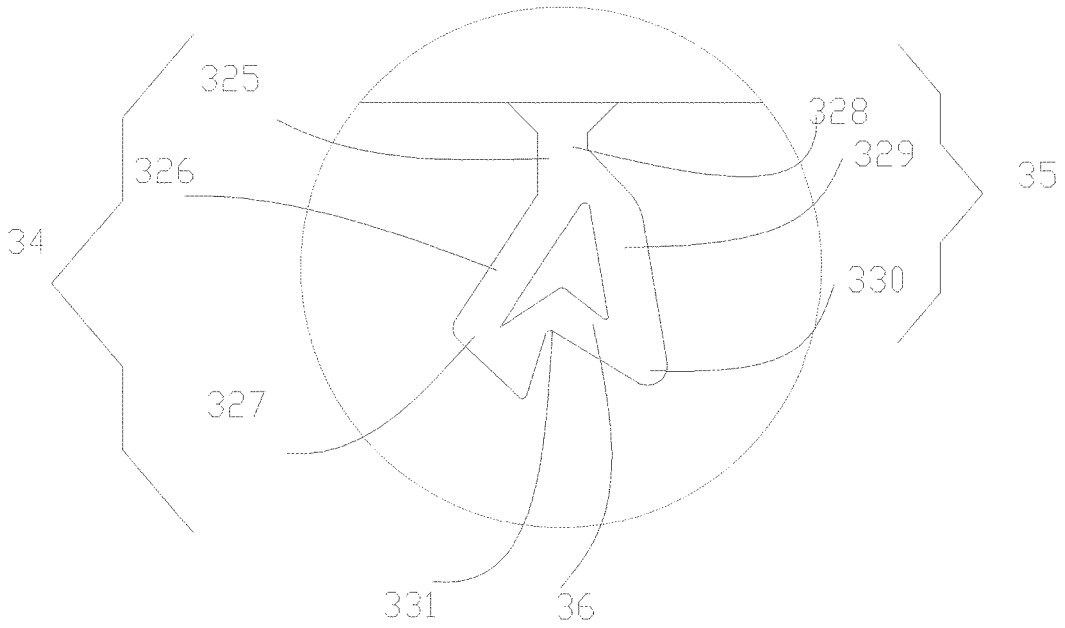
FIG. 6 is an enlarged view of the portion A shown in FIG. 5.

Referring to FIG. 1 and FIG. 2, an electronic cigarette comprises an atomizer 1 and a battery rod 2. A connecting structure 3 configured for connecting the atomizer 1 with the battery rod 2 is disposed at a butt-jointed position between the atomizer 1 and the battery rod 2. The electronic cigarette further comprises an elastic structure 33 disposed on an end of the connecting structure 3. In this embodiment, the elastic structure 33 is a spring. In other embodiments, the elastic structure 33 can also be an elastic rubber member, etc.

An end of the atomizer 1 that is far away from the connecting structure 3 is provided with a suction nozzle cover 19. The atomizer 1 includes an atomization sleeve 18 connected with the suction nozzle cover 19 by an interference fit. A breather pipe 14 and an atomization seat 12 are successively mounted in the atomization sleeve 18 along a direction from the suction nozzle cover 19 to the connecting structure 3, and the breather pipe 14 is provided with a heating assembly 16 configured for atomizing smoke oil. The suction nozzle cover 19 is engaged with a top of the atomization sleeve 18, and a method for connecting the suction nozzle cover 19 with the atomization sleeve 18 can be a detachable connection, such as a thread engagement or an interference fit. A receiving space configured for receiving an oil storage cotton 17, a fixing pipe 15, and a non-woven fabric is formed between an outer wall of the breather pipe 14 and an inner wall of the atomization sleeve 18. The breather pipe 14 defines a through-hole (not labeled) configured for mounting the heating assembly 16, so that the heating assembly 16 can heat smoke oil in the oil storage cotton 17 to atomize the smoke oil.

The battery rod 2 includes a battery sleeve 26. An end of the battery sleeve 26 is connected with the connecting structure 3, and a lamp cap 29 is mounted on an end of the battery rod 2 that is far away from the connecting structure 3. An optional connection method between the lamp cap 29 and the battery sleeve 26 can be an interference fit or a threaded connection, etc. An airflow sensor 28, an airflow sensor seat 27, and a battery 25 are successively disposed in the battery sleeve 26 along a direction from the lamp cap 29 to the connecting structure 3. The airflow sensor seat 27 is configured for mounting the airflow sensor 28 thereon, and the battery 25 is configured for supplying power to the atomizer 1.

Referring to FIG. 3 to FIG. 6, the connecting structure 3 includes a first connecting member 31 and a second connecting member 32. The first connecting member 31 and the second connecting member 32 are detachably connected with each other. The first connecting member 31 is disposed on an end of the atomizer 1 facing the battery rod 2. It is understandable that the first connecting member 31 can also be disposed on an end of the battery rod 2 facing the atomizer 1. A side surface of the first connecting member 31 is provided with at least one engaging portion 311. In this embodiment, the side surface of the first connecting member 31 is provided with a pair of engaging portions 311, so that the connection between the first connecting member 31 and the second connecting member 32 is more stable. A distal end of the engaging portion 311 has a spherical shape, so that the engaging portion 311 is easier to connect with the second connecting member 32 by butt joint. The engaging portion 311, the first connecting member 31, and the atomization sleeve 18 are integrally formed, so that the assembly of the electronic cigarette is ensured to be simple and a size of the electronic cigarette is accurate, which improves quality and aesthetics of the electronic cigarette. The electronic cigarette further includes a first insulation sleeve 21 axially inserted in a central position of the first connecting member 31 and a first electrode 11 inserted in a central position of the first insulation sleeve 21. The first electrode 11 and the first connecting member 31 are electrically connected with two ends of the heating assembly 16 respectively.

The second connecting member 32 is mounted on an end of the battery rod 2 facing the atomizer 1. It is understandable that the second connecting member 32 can also be mounted on an end of the atomizer 1 facing the battery rod 2. The second connecting member 32 defines a butt-jointed groove 324 configured for receiving the first connecting member 31. In assembly, the butt-jointed groove 324 engages with an end of the first connecting member 31 by butt-joint. A wall of the butt-jointed groove 324 extends away from a rabbet of the butt-jointed groove 324 to form at least one channel structure. The channel structure includes an inserting guide channel 34, a taking-out guide channel 35, and a bending channel 36 communicating with a first bottom 327 of the inserting guide channel 34 and a second bottom 330 of the taking-out guide channel 35 respectively. The bending channel 36 bends towards the rabbet of the butt jointed groove 324 and forms a buckled portion 331 at a bending part of the bending channel 36. In this embodiment, because the first connecting member 31 is provided with a pair of the engaging portions 311, the second connecting member 32 defines a pair of the channel structures corresponding to the pair of the engaging portions 311. The electronic cigarette further includes an electrode sleeve 24 axially inserted in a central position of the second connecting member 32, a second insulation sleeve 22 embedded in the electrode sleeve 24, and a second electrode 23 inserted in a shared central position of the second insulation sleeve 22 and the electrode sleeve 24. The channel structure can also be defined in an inner wall of the electrode sleeve 24. The second connecting member 32 and the second electrode 23 are electrically connected with a positive pole and a negative pole of the battery 25 respectively.

In this embodiment, the elastic structure 33 is a spring. The elastic structure 33 is sheathed on the second electrode 23, and two ends of the elastic structure 33 abut against the second electrode 23 and the electrode sleeve 24 respectively. Specifically, an accommodating space (not labeled) is formed between the electrode sleeve 24 and the second electrode 23, and the second electrode 23 is provided with a bulge portion (not labeled) formed along a circumferential direction of the second electrode 23. The elastic structure 33 is received in the accommodating space and is sheathed on an outer wall of the second electrode 23, one end of the elastic structure 33 abuts against the bulge portion, and the other end of the elastic structure 33 abuts against an inner wall of the electrode sleeve 24.

In this embodiment, both the inserting guide channel 34 and the taking-out guide access 35 lean relative to an axis of the second connecting member 32, and the taking-out guide channel 35 and the inserting guide channel 34 lean to two opposite directions respectively. When the engaging portion 311 moves in the channel structure, the engaging portion 311 merely needs a little force to be driven to move upward.

In this embodiment, the inserting guide channel 34 and the taking-out guide channel 35 are formed symmetrically based on the axis of the second connecting member 32.

In this embodiment, a first top 325 of the inserting guide channel 34 communicates with a second top 328 of the taking-out guide channel 35, and a first middle portion 326 of the inserting guide channel 34 is separated from a second middle portion 329 of the taking-out guide channel 35.

Specifically, the first top 325 of the inserting guide channel 34 communicates with the second top 328 of the taking-out guide channel 35, the first top 325 and the second top 328 are positioned symmetrically based on the axis of the second connecting member 32, and both the first top 325 and the second top 328 are disposed at the rabbet of the butt-jointed groove 324. The first middle portion 326 of the inserting guide channel 34 extends away from the axis of the second connecting member 32 along a distal end of the first top 325, the second middle portion 329 of the taking-out guide channel 35 extends away from the axis of the second connecting member 32 along a distal end of the second top 328, and the first middle portion 326 and the second middle portion 329 are separated from each other. A distance between the inserting guide channel 34 and the taking-out guide channel 35 gradually increases along a direction that is far away from the rabbet of the butt-jointed groove 324. The first bottom 327 of the inserting guide channel 34 extends towards the axis of the second connecting member 32 along a distal end of the first middle portion 326, and the second bottom 330 of the taking-out guide channel 35 extends towards the axis of the second connecting member 32 along a distal end of the second middle portion 329. The first bottom 327 of the inserting guide channel 34 communicates with the second bottom 330 of the taking-out guide channel 35 via the bending channel 36. A middle portion of the bending channel 36 bends to form a bulge facing the rabbet of the butt-jointed groove 324.

In this embodiment, the elastic structure 33 is mounted on an end of the second connecting member 32. The elastic structure 33, the second connecting member 32, and the first connecting member 31 are disposed coaxially with each other, so that elasticity provided by the elastic structure 33 is ensured to be all forced on the first connecting member 31. In this embodiment, the elastic structure 33 is disposed in the battery rod 2. It is understandable that when the second connecting member 32 is disposed in the atomizer 1, the elastic structure 33 can also be correspondingly disposed in the atomizer 1.

The connecting structure further defines an airflow passage in a central position of the first connecting member 31 and a central position of the second connecting member 32, and the airflow passage communicates the first connecting member 31 with the second connecting member 32. The airflow passage further communicates with the breather pipe 14, so that air inhaled from an end of the electronic cigarette is mixed with smoke generated in the atomizer 1, and then the mixture of the air and the smoke is inhaled into a mouth of a smoker.

The working principle of the present invention will be further described specifically below.

In assembly, the first connecting member 31 is mounted on an end of the atomizer 1, and the second connecting member 32 is mounted on an end of the battery rod 2. The first insulation sleeve 21 and the first electrode 11 inserted in a central position of the first insulation sleeve 21 are both mounted at a central position of the first connecting member 31. The electrode sleeve 24, the second insulation sleeve 22 embedded in the electrode sleeve 24, and the second electrode 23 inserted in the shared central position of the second insulation sleeve 22 and the electrode sleeve 24 are all mounted at a central position of the second connecting member 32. Both two ends of the second electrode 23 extend out of the second connecting member 32, and one end of the second electrode 23 is electrically connected with the first electrode 11.

Figure 7:
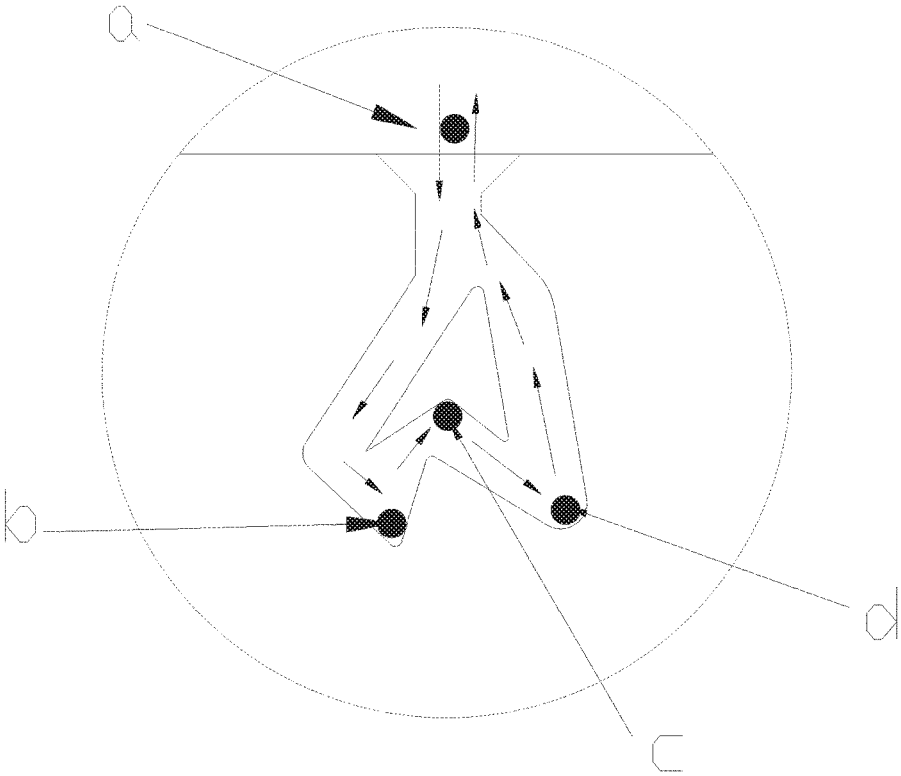
FIG. 7 is a schematic view of working principle of the connecting structure shown in FIG. 1.
Figure 8:
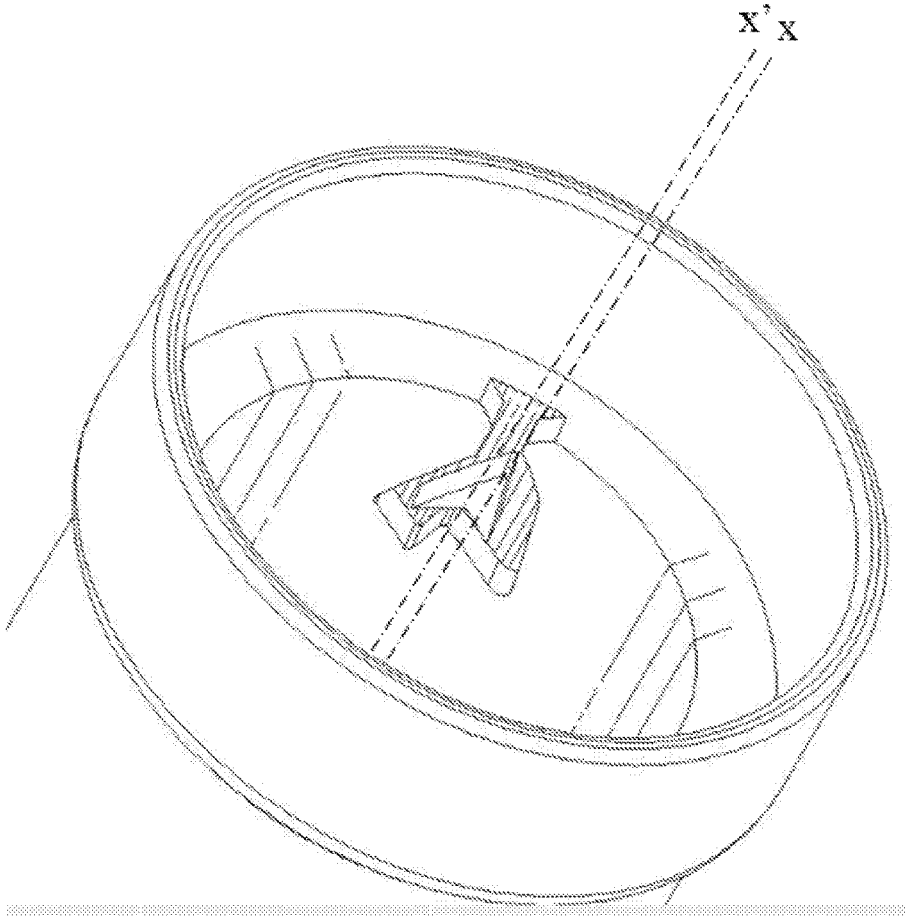
FIG. 8 is an amplify view of section B in the connecting structure shown in FIG. 1.

When connecting the atomizer 1 with the battery rod 2, a user can align the atomizer 1 with the battery rod 2, and insert a front end of the first connecting member 31 into the butt-jointed groove 324 of the second connecting member 32. The engaging portion 311 moves at first to be inserted into the first top 325 of the inserting guide channel 34, that is, the location of the Point a shown in FIG. 7. Thus, the atomizer 1 is pressed to further insert the engaging portion 311 into the second connecting member 32, so that the engaging portion 311 moves along the inserting guide channel 34 and arrives at the first bottom 327 of the inserting guide channel 34, that is, the location of the Point b shown in FIG. 7. Meanwhile, the elastic structure 33 connected with an inner side of an end of the second connecting member 32 is pressed and generates elastic deformation. After arriving at the Point b, the engaging portion 311 is unable to be further inserted inwards. When the user stops pressing, the elastic structure 33 recovers the elastic deformation and supplies restoring force to drive the engaging portion 311 to move upward along the bending channel 36. When the engaging portion 311 arrives at the buckled portion 331, the first connecting member 31 is buckled to connect with the second connecting member 32.

When the first connecting member 31 and the second connecting member 32 are disconnected from each other, the user can press the atomizer 1 again, so that the engaging portion 311 undergoes force again and is driven to move towards the taking-out guide channel 35 along the bending channel 36. Meanwhile, the elastic structure 33 is pressed and generates elastic deformation. When the engaging portion 311 arrives at the second bottom 330 of the taking-out guide channel 35, the user can stop pressing. Thus, the elastic structure 33 recovers the elastic deformation and supplies restoring force to drive the engaging portion 311 to move towards the rabbet of the butt-jointed groove 324 along the taking-out guide channel 35, so that the first connecting member 31 is disconnected from the second connecting member 32.

It will be understood by those skilled in the art that various changes may be made and equivalents may be substituted without departing from the purpose of the invention and the scope of the claims, but all the changes will be included within the scope of the appended claims.

What is claimed is:

1. An electronic cigarette, comprising an atomizer, a battery rod, and a connecting structure disposed at a butt-jointed position between the atomizer and the battery rod to connect the atomizer with the battery rod; the connecting structure including a first connecting member and a second connecting member;

wherein, the electronic cigarette further comprises an elastic structure disposed on an end of the connecting structure;

wherein, a side surface of the first connecting member is provided with at least one engaging portion, the second connecting member defines a butt-jointed groove configured for receiving the first connecting member, and at least one channel structure is defined on an inner sidewall of the second connecting member along an axial direction of the second connecting member, the channel structure extends toward an opposite direction of a rabbet of the butt-jointed groove and is communicated with the butt-jointed groove; the channel structure includes an inserting guide channel, a taking-out guide channel, and a bending channel communicating with both a first bottom of the inserting guide channel and a second bottom of the taking-out guide channel respectively; the bending channel bends towards the rabbet of the butt-jointed groove and forms a buckled portion at a bending part of the bending channel; the elastic structure is configured for supplying elasticity towards the rabbet of the butt-jointed groove to the first connecting member, so that the engaging portion is engaged with the buckled portion to realize a connection between the atomizer and the battery rod.

2. The electronic cigarette of claim 1, wherein, the electronic cigarette further includes an electrode sleeve axially inserted in the second connecting member and a second electrode inserted in a central position of the electrode sleeve.

3. The electronic cigarette of claim 2, wherein, the elastic structure is a spring, and the spring is sheathed on the second electrode and is abutted against the second electrode and the electrode sleeve respectively.

4. The electronic cigarette of claim 2, wherein, the side surface of the first connecting member is provided with a pair of the engaging portions, and the second connecting member defines a pair of the channel structures corresponding to the pair of the engaging portions.

5. The electronic cigarette of claim 4, wherein, both the inserting guide channel and the taking-out guide channel lean relative to an axis of the second connecting member, and the taking-out guide channel and the inserting guide channel lean to two opposite directions respectively.

6. The electronic cigarette of claim 5, wherein, the inserting guide channel and the taking-out guide channel are formed symmetrically based on the axis of the second connecting member.

7. The electronic cigarette of claim 4, wherein, a first top of the inserting guide channel communicates with a second top of the taking-out guide channel, and a first middle portion of the inserting guide channel is separated from a second middle portion of the taking-out guide channel.

8. The electronic cigarette of claim 7, wherein, the first middle portion of the inserting guide channel extends away from the axis of the second connecting member along a distal end of the first top, and the first bottom of the inserting guide channel extends towards the axis of the second connecting member along a distal end of the first middle portion.

9. The electronic cigarette of claim 8, wherein, the second middle portion of the taking-out guide channel extends away from the axis of the second connecting member along a distal end of the second top, and the second bottom of the taking-out guide channel extends towards the axis of the second connecting member along a distal end of the second middle portion.

10. The electronic cigarette of claim 4, wherein, a distal end of the engaging portion has a spherical shape.

11. The electronic cigarette of claim 10, wherein, the first connecting member and the engaging portion are integrally formed.

12. The electronic cigarette of claim 1, wherein, the first connecting member and the second connecting member are disposed coaxially with each other.

13. The electronic cigarette of claim 12, wherein, the second connecting member is disposed on one end of the battery rod facing the atomizer or on one end of the atomizer facing the battery rod.

14. The electronic cigarette of claim 13, wherein, the first connecting member is disposed on one end of the atomizer facing the battery rod or on one end of the battery rod facing the atomizer.

15. The electronic cigarette of claim 1, wherein, the electronic cigarette further includes a first insulation sleeve axially inserted in the first connecting member and a first electrode inserted in a central position of the first insulation sleeve.

16. The electronic cigarette of claim 1, wherein, the connecting structure defines an airflow passage communicating the first connecting member with the second connecting member.

* * * * *